US007694862B2

(12) United States Patent
Bergeron

(10) Patent No.: US 7,694,862 B2
(45) Date of Patent: Apr. 13, 2010

(54) INTERDIGITATING QUICK RELEASE WEB FASTENER

(75) Inventor: Daniel Bergeron, Vancouver (CA)

(73) Assignee: ARC'TERYX Equipment Inc., North Vancouver, BC (CA)

( * ) Notice: Subject to any disclaimer, the term of this patent is extended or adjusted under 35 U.S.C. 154(b) by 684 days.

(21) Appl. No.: 10/871,836

(22) Filed: Jun. 17, 2004

(65) Prior Publication Data

US 2005/0015944 A1 Jan. 27, 2005

Related U.S. Application Data

(60) Provisional application No. 60/479,148, filed on Jun. 18, 2003, provisional application No. 60/516,309, filed on Nov. 3, 2003.

(51) Int. Cl.
*A45F 5/00* (2006.01)
*A44B 21/00* (2006.01)

(52) U.S. Cl. ..... 224/665; 224/675; 24/3.7

(58) Field of Classification Search ..... 224/579, 224/674, 675, 677, 665, 668, 671, 672; 24/3.7
See application file for complete search history.

(56) References Cited

U.S. PATENT DOCUMENTS

| | | | | | |
|---|---|---|---|---|---|
| 842,498 | A | | 1/1907 | Schmidt | |
| 3,324,991 | A | * | 6/1967 | Voss | 198/844.2 |
| 3,735,451 | A | * | 5/1973 | Haythornthwaite | 24/33 C |
| 4,364,421 | A | * | 12/1982 | Martin | 139/383 AA |
| 5,015,220 | A | * | 5/1991 | Legge et al. | 474/256 |
| 5,259,093 | A | | 11/1993 | D'Annuzio | 24/3 |
| 5,261,728 | A | * | 11/1993 | Carmichael | 297/482 |
| 5,617,582 | A | | 4/1997 | Burwell | 2/102 |
| 5,632,071 | A | * | 5/1997 | Maunder | 24/580.1 |
| 5,724,707 | A | | 3/1998 | Kirk et al. | 24/3.7 |
| D411,659 | S | * | 6/1999 | Karton | D3/226 |
| 6,102,266 | A | * | 8/2000 | Chacon et al. | 224/679 |
| 6,158,642 | A | * | 12/2000 | Herbage | 224/675 |
| 6,279,804 | B1 | | 8/2001 | Gregg | 224/675 |
| 7,047,570 | B2 | * | 5/2006 | Johnson | 2/102 |
| 7,080,430 | B2 | * | 7/2006 | Wemmer | 24/578.13 |
| 2006/0113344 | A1 | * | 6/2006 | Cragg | 224/579 |
| 2006/0242799 | A1 | * | 11/2006 | Flossner | 24/3.7 |

* cited by examiner

*Primary Examiner*—Nathan J Newhouse
*Assistant Examiner*—Justin M Larson
(74) *Attorney, Agent, or Firm*—Greenblum & Bernstein, P.L.C.

(57) ABSTRACT

A fastening system for attaching an article to a support. A web fastener may be attached to an article at one end and have a free distal end, distanced from the article. A distal portion of the web fastener is stiffened and a proximal portion is more flexible than the stiffened portion. The article and support each have juxtaposable webbing strips forming webbing channels. The web fastener is insertable through and between the juxtaposed support webbing channels and article webbing channels to thereby secure the mated article and support against relative movement. In additional embodiments connectors are provided at the proximal and distal ends of the web fastener to secure the relative positions thereof, and multiple support webbing channels, article webbing channels and web fasteners are provided.

55 Claims, 6 Drawing Sheets

INTERDIGITATING QUICK RELEASE WEB FASTENER

This application claims the benefit of U.S. Provisional Application No. 60/479,148 filed on 18 Jun. 2003, and of U.S. Provisional Application No. 60/516,309 filed on 3 Nov. 2003.

FIELD

The subject matter disclosed and claimed is in the field of attachment systems for use in attaching pockets or other accessories to vests, belts, or other supports, using interlocking webbing, this being of particular use with clothing and individual load bearing equipment and particularly clothing and individual load bearing equipment for military use.

BACKGROUND

Various systems have been adapted for the attachment of articles to clothing systems and load bearing equipment that utilize interlocking patterns of webbing including, for example, those disclosed in U.S. Pat. Nos. 5,617,582; 5,724,707; and 6,279,804.

SUMMARY

In one aspect, there is disclosed a fastening system for attaching an article to a support. The fastening system may comprise a web fastener attached to the article at a fixed end, and having a distal free end spaced apart from the article. A distal portion of the web fastener is stiffened, and this stiffened portion is spaced apart from the article by a flexible portion of the web fastener (the flexible portion of the web fastener being more flexible than the stiffened portion of the web fastener). Connecting elements, such as the mating components of a snap fastener, may be provided at the proximal and distal ends of the web fastener.

In a first embodiment there is disclosed a fastening system for attaching an article to a support. An article webbing strip is attached to the article mounting surface of the article, and an article webbing channel is defined between the article webbing strip and the article mounting surface. A support webbing strip is attached to a support mounting surface on the support, a support webbing channel is defined between the support webbing strip and the support mounting surface. The support mounting surface is matable to the article mounting surface to juxtapose the support webbing channel and the article webbing channel when the article is attached to the support. A web fastener is provided and comprises: (a) a fixed end attached to the article and a distal end not attached to the article, so that the web fastener extends from the fixed end to the distal end in an orientation that permits the web fastener to pass through the juxtaposed article webbing channel and support webbing channel when the article is mounted to the support; (b) a flexible portion adjacent to the fixed end; and (c) a stiffened portion that is more rigid than the flexible portion, and is spaced apart from the fixed end by the flexible portion. The stiffened and flexible portions of the web fastener are each long enough to extend through and between the juxtaposed support webbing channel and article webbing channel when the article is mounted to the support.

In a second embodiment there is provided an article adapted for attachment to a support comprising a support webbing channel. The article has an article webbing strip attached to an article mounting surface on the article and defining an article webbing channel with the article mounting surface, the article mounting surface being matable with the support mounting surface to juxtapose the article webbing channel with the support webbing channel when the article is attached to the support. The article also has a web fastener comprising: (a) a fixed end attached to the article and a distal end not attached to the article, with the web fastener extending from the fixed end to the distal end in an orientation that permits the web fastener to pass through and between the juxtaposed article webbing channel and support webbing channel; (b) a flexible portion adjacent to the fixed end; and (c) a stiffened portion that is more rigid than the flexible portion, and is spaced apart from the fixed end by the flexible portion. In this embodiment, the stiffened portion of the web fastener and the flexible portion of the web fastener are each long enough to extend through the juxtaposed support webbing channel and article webbing channel when the article is mounted on the support In a third embodiment there is described a method for connecting an article to a support by inserting a web fastener through and between juxtaposed webbing channels. The method comprises providing a fastening system itself comprising an article webbing strip attached to an article mounting surface on the article, thereby defining an article webbing channel between the article webbing strip and the article mounting surface. The article further comprises a support webbing strip attached to a support mounting surface on the support, thereby defining a support webbing channel between the support webbing strip and the support mounting surface. The support mounting surface is matable to the article mounting surface to juxtapose the support webbing channel and the article webbing channel when the article is attached to the support. The article also comprises a web fastener comprising: (a) a fixed end attached to the article and a distal end, so that the web fastener extends from the fixed end to the distal end in an orientation that permits the web fastener to pass through the juxtaposed article webbing channel and the support webbing channel when the article is mounted to the support; (b) a flexible portion adjacent to the fixed end; and (c) a stiffened portion that is more rigid than the flexible portion, and is spaced apart from the fixed end by the flexible portion. The stiffened portion of the web fastener and the flexible portion of the web fastener are each long enough to extend through and between the juxtaposed support webbing channel and article webbing channel when the article is mounted to the support.

In a further embodiment there is disclosed a fastening system for attaching an article to a support. The system comprises: (a) two article webbing strips attached to an article mounting surface on the article and defining a plurality of article webbing channels between the article webbing strips and the article mounting surface; (b) two support webbing strips attached to a support mounting surface on the support, defining a plurality of support webbing channels between the support webbing strips and the support mounting surface, the support mounting surface being matable to the article mounting surface to juxtapose ones of the support webbing channels and ones of the article webbing channels when the article is attached to the support; and, (c) two web fasteners. Each web fastener comprises: (i) a fixed end attached to the article and a distal end, so that the web fastener extends from the fixed end to the distal end in an orientation that permits the web fastener to pass through a juxtaposed article webbing channel and the support webbing channel when the article is mounted to said support; (ii) a flexible portion adjacent to the fixed end; (iii) a stiffened portion that is more rigid than the flexible portion, and is spaced apart from the fixed end by the flexible portion; and (iv) a snap fastener, mating parts of the snap fastener being positioned to connect the distal end of the web fastener proximate to the fixed end. The stiffened portion of the web fastener and the flexible portion of the web fastener are each long enough to extend through and between a plurality of juxtaposed support webbing channels and article webbing channels when the article is mounted to a support.

In further embodiments the stiffened portion of the web fastener further comprises a distal connecting element, that distal connecting element being connectable to a proximal connecting element proximate the first end of the webbing strap.

In still further embodiments, the article disclosed further comprises more than one article webbing channel, more than one web fastener, or more than one article webbing channel and more than one web fastener.

In still further embodiments the article comprises two article webbing channels, those two article webbing channels being generally mutually parallel; the support comprises two support webbing channels, those two support webbing channels being generally mutually parallel; and the stiffened portion of the web fastener is adapted to extend through and between ones of the support webbing channels and ones of the article webbing channels to thereby restrain relative movement of the article and the support In still further embodiments, the support may be an article of clothing or may be individual load bearing equipment and the article may be a pocket, a holster, a gun support or a holder.

In still further embodiments, the embodiments disclosed above are provided as part of a military kit.

DETAILED DESCRIPTION OF THE PREFERRED EMBODIMENTS

Figure 1:
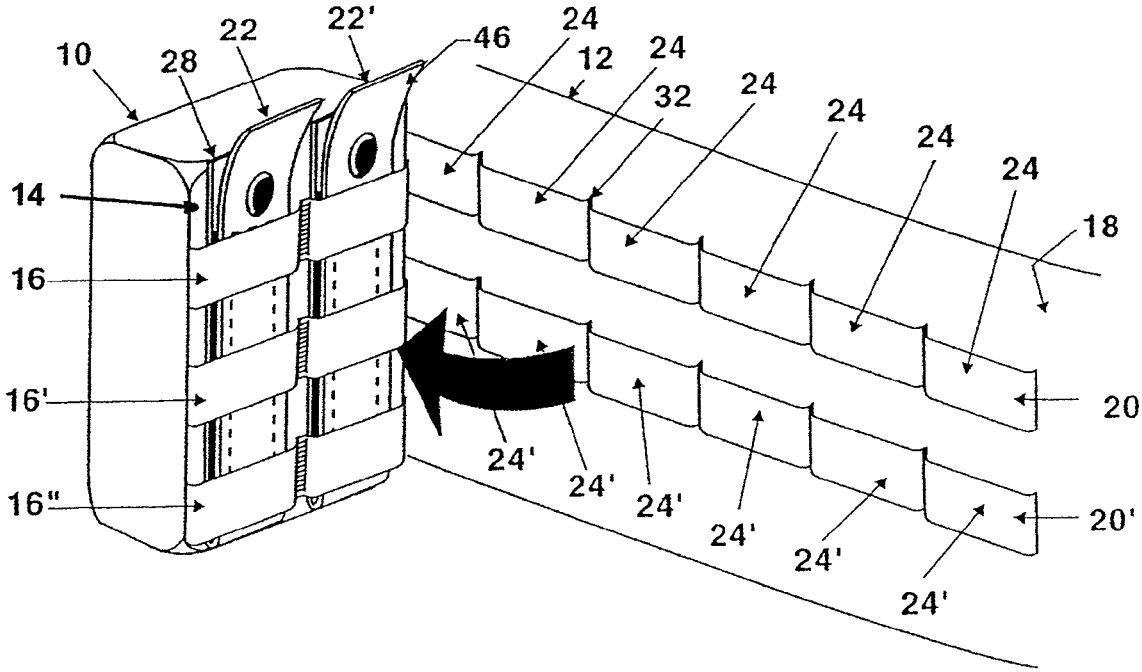
FIG. 1 is a perspective view of a support and article of a first embodiment.

The first embodiment is illustrated with reference to FIGS. 1-7. Each of article 10 and support 12 has an associated mounting surface whereon are mounted webbing strips. Article 10 has an associated article mounting surface 14 whereon are mounted generally parallel article webbing strips 16, 16', 16" and support 12 has a support mounting surface 18 whereon are mounted generally parallel support webbing strips 20, 20'. Two web fasteners 22, 22' are vertically interwoven with mutually juxtaposed horizontal article webbing strips 16, 16', 16" and support webbing strips 20, 20'. Support webbing strips 20 and underlying support mounting surface 18, describe therebetween a number of generally parallel support webbing channels 24. Support webbing strip 20' and underlying support mounting surface 18 describe therebetween a further series of generally parallel support webbing channels 24' which are generally aligned with corresponding support webbing channels 24. Support webbing channels 24 and 24' are themselves generally perpendicular to the support webbing strips 20, 20'. Similarly article webbing strips 16, 16', 16" and underlying article mounting surface 14 describe therebetween article webbing channels 26, 26', 26" (see FIG. 3) generally perpendicular to the orientation of the article webbing strips 16, 16', 16".

Figure 4:
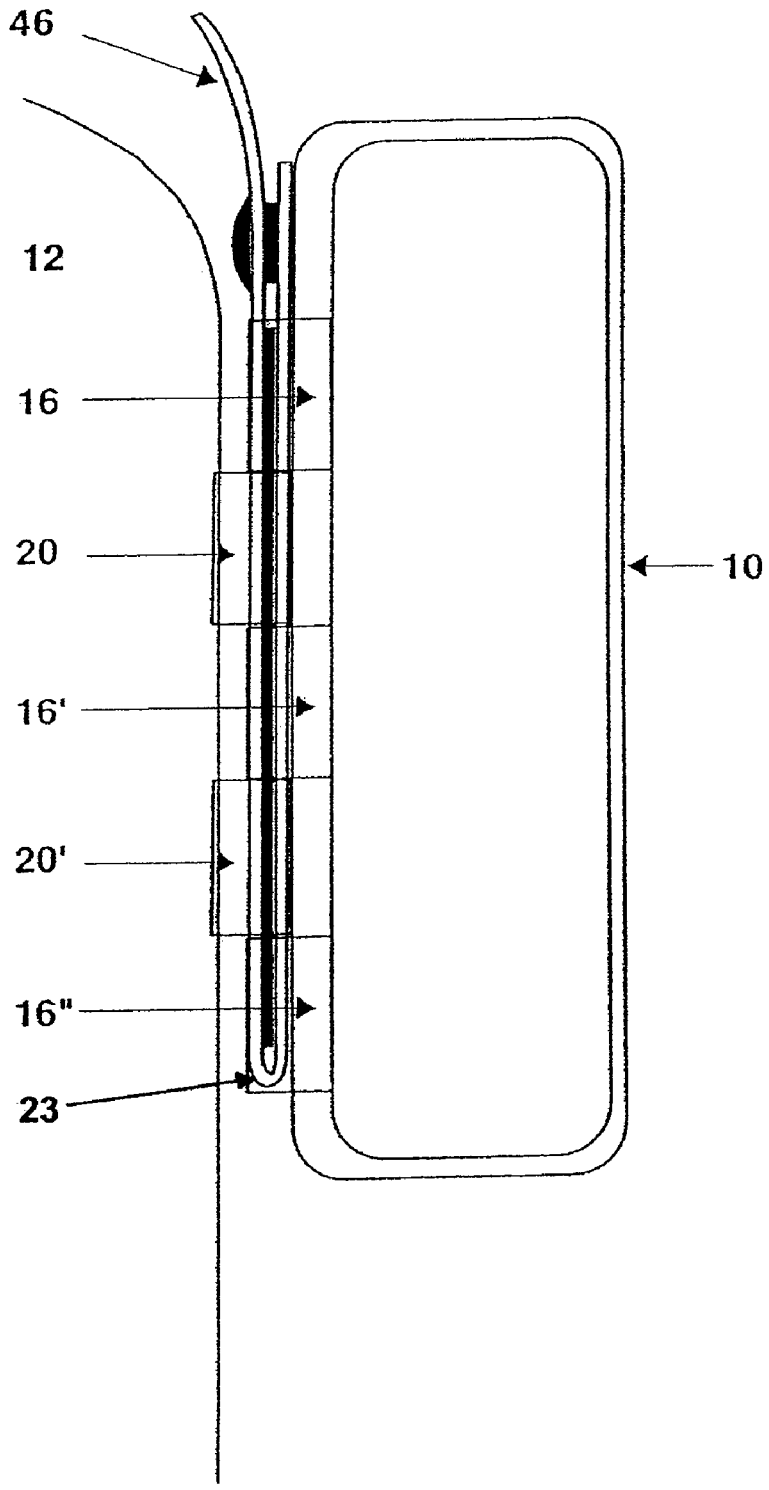
FIG. 4 is a cross sectional view of the mated article and support of the first embodiment.

As best illustrated in FIG. 4, when article mounting surface 14 is mated to support mounting surface 18, support webbing strips 20, 20' and article webbing strips 16, 16' 16" are interdigitated, thereby juxtaposing article webbing channels 26, 26' 26" and support webbing channels 24, 24'. Web fastener 22 passes from its fixed end 28 at point of attachment 30 on the article mounting surface 14 through article webbing channel 26, then through support webbing channel 24, then through another article webbing channel 26', then through another support webbing channel 24', and into article webbing channels 26". The juxtaposition of article webbing channels 26, 26', 26" and support webbing channels 24, 24' is necessary for the web fastener 22 to be inserted through and between them to thereby restrain relative movement of the support mounting surface 18 and the article mounting surface 14. Such juxtaposition does not require the snug interdigitation of the support webbing channels and the article webbing channels, so long as the basic interlacing of the web fastener 22 with the support webbing channels 24 and article webbing channels 26, is accomplished.

Figure 2:
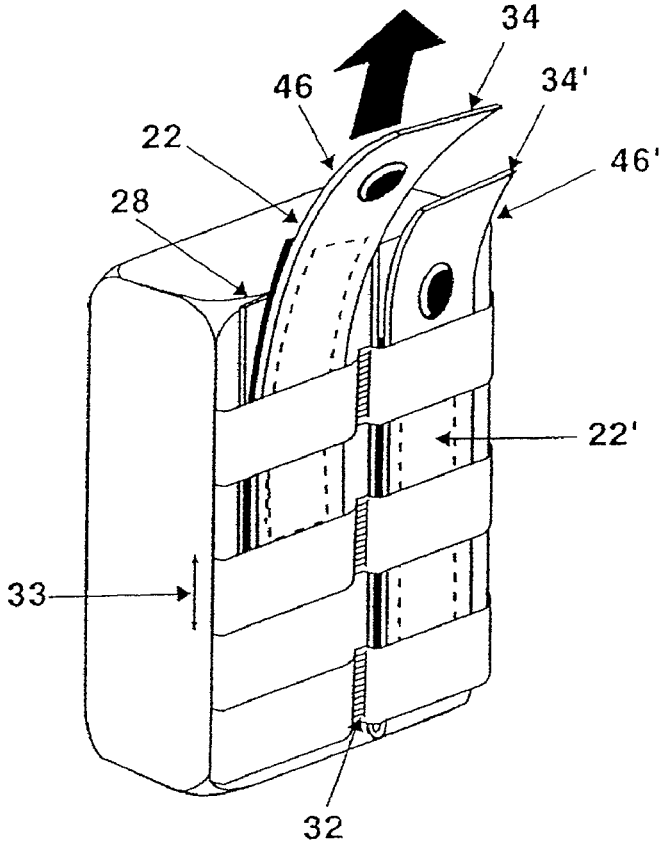
FIG. 2 is a perspective view of an article of the first embodiment showing the web fastener partly inserted.
Figure 3:
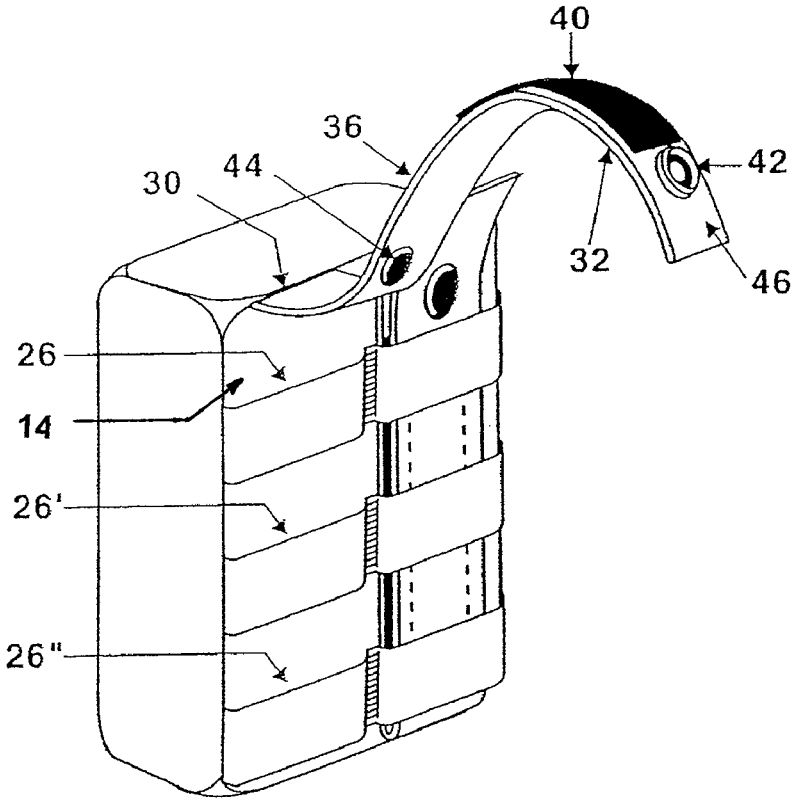
FIG. 3 is a perspective view of an article of the first embodiment showing the web fastener fully withdrawn.

In the illustrated embodiment, the webbing strips are attached to their respective mounting surfaces by stitching. The dimensions of the article webbing channels are determined by the depth 33 of the article webbing strips 16, and the positioning of vertical rows of stitching 32 which divide the article webbing strips along their length. See. e.g., FIG. 2. The depth of an article webbing channels, therefore, is defined as extending between a first edge and a second edge of the article webbing strip 16, such edges, in FIG. 2, shown as an upper horizontally extending edge and a lower horizontally extending edge. The support webbing channels 24 are similarly defined. Although stitching is one way to secure the webbing strips to their respective surfaces and define the webbing channels, a range of suitable alternatives are incorporated in alternative embodiments and include but are not limited to adhesives, studs, heat sealing, interweaving, unitary fabrication of surface and its associated webbing strip and the like. Similarly, other means to form the necessary channels are possible, such as pre fabricated channels, loops and the like.

Figure 8:
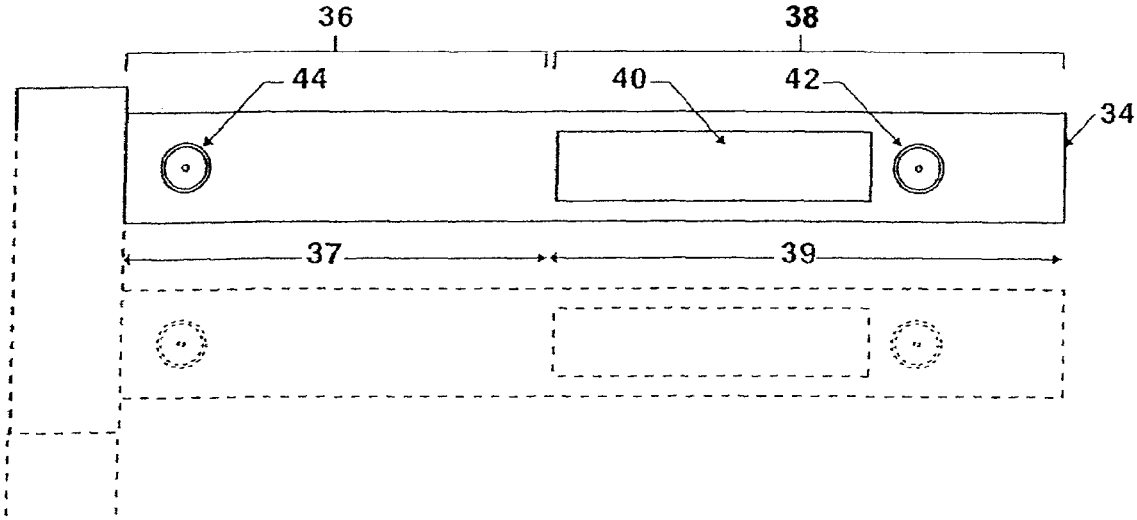
FIG. 8 shows the structure of a web fastener of the first embodiment.

In some embodiments, web fastener 2 comprises a fixed end 28, a distal end 34, a flexible portion 36 and a stiffened portion 38 distal to the fixed end 28 and separated therefrom by the flexible portion 36. As shown in FIG. 8, flexible portion 36 has a length 37, and stiffened portion 38 has a length 39. Over at least a part of its length 39 the stiffened portion 38 is substantially less flexible than flexible portion 36 because of the provision of a stiffener 40. Fixed end 28 of web fastener 22 is attached to article 10 at attachment point 30 (see FIG. 3) on article mounting surface 14. Webbing strip 16 comprises a stiffener 40, such as a stiff plastic material sewn to webbing strip 16. Many alternative methods for providing this difference in flexibility are encompassed in alternative embodiments, including the use of different materials, such as wood, metal or plastic stiffening elements, the incorporation of the stiffening element in the interior or the web fastener 22, and the use of different materials to fabricate the flexible and stiffened portions of the web fastener 22. In some embodiments (see FIG. 4, e.g.), in a position of engagement between the article and the support, i.e., when the article is mounted to the support, web fastener 22 folds back on itself, forming a bight 23, so that the stiffened portion 38, bearing a distal connector element 42, returns back through the series of article and support webbing channels 24,26. whereby two portions of the web fastener, i.e., portions of the flexible portion and stiffened portion, create a two-layered extent of the web fastener extending through the series of article and support webbing channels, so that distal connector element 42 associated with stiffened portion 38 can be engaged with proximal connector element 44, close to the fixed end 28 of web fastener 22. In this embodiment the proximal connector element 44 is located on the web fastener 22 close to its fixed end 28 but other locations, including locations directly on the article mounting surface 14 may be used so long as these are proximate the fixed end 28 of the web fastener 22. The distal connector 42 may be positioned along the length of the stiffener 40, or slightly distal thereto as illustrated, and the stiffened portion 38 may extend distal to the distal connector 42 with the distal end 34 of the web fastener 22 forming a tab or other structure 46 grippable by a user. In the illustrations the proximal 44 and distal connectors 42 are the mating parts of a snap fastener but numerous suitable alternative connectors are encompassed by alternative embodiments, these include but are not limited to pins, VELCRO.TM., hooks and eyes, clips, zippers and the like.

Figure 5:
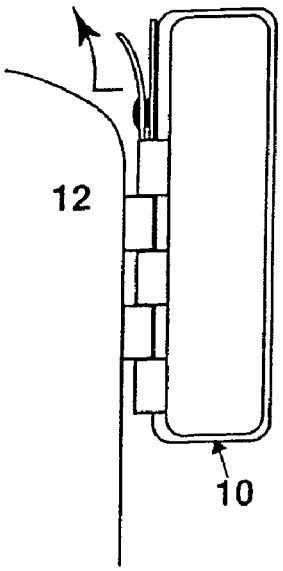
FIG. 5 is a lateral view of the mated article and support of the first embodiment.
Figure 6:
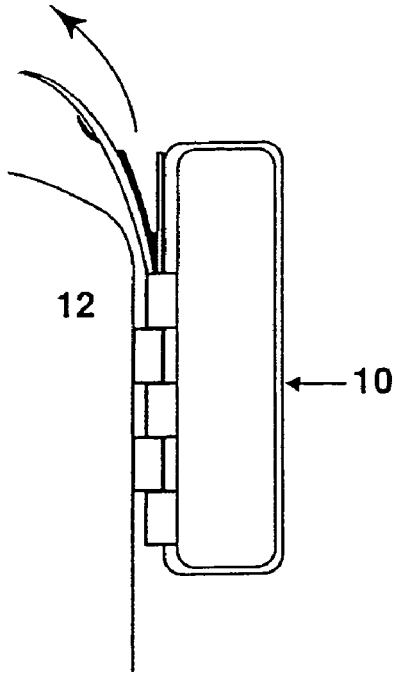
FIG. 6 shows an intermediate step in disengagement of the article and support of the first embodiment illustrated in FIG. 5.
Figure 7:
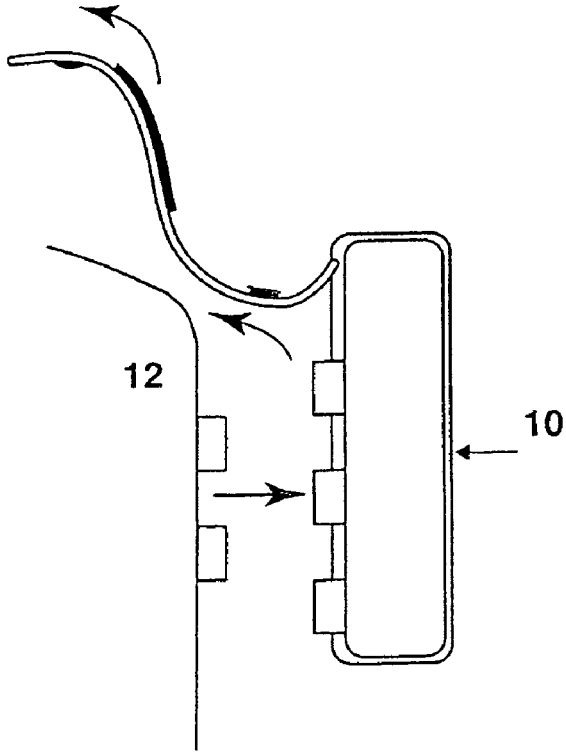
FIG. 7 shows a final step in disengagement of article from support of the first embodiment illustrated in FIGS. 5 and 6.

In various embodiments the proximal 44 and distal 42 connectors may be so positioned that they can be properly opposed and connected to thereby restrain the movement of the stiffened portion Stiffener 40 facilitates the insertion of web fastener 22 through the article webbing channels 26 and support webbing channels 24. As shown in FIGS. 5 through 7, the embodiments provide for the quick release of article 10 from support 12, by disengaging connecting elements 42 and 44, and pulling on the tab 46 at distal end 34 of web fastener 22, in a direction away from the interdigitated support and article webbing channels, so that the flexible portion 36 of web fastener 22 rolls back along itself to disengage article 10 from support 12, as ultimately illustrated in FIG. 7. During the rolling back of the web fastener, the bight 23, or fold, moves in a direction along the web fastener toward the fixed end, i.e., upwardly in FIG. 7, until the entirety of the web fastener, affixed to the article 10, is disengaged from the support 12. Assembly of the fastening system is accomplished by reversing the process. The article mounting surface 14 and the support mounting surface 18 are placed in mating opposition, so that article webbing channels 26 are juxtaposed to support webbing channels 24. Stiffener 40 facilitates the insertion of the web fastener 22 through and between article webbing channels 26 and support webbing channels 24 to thereby restrain the opposed article mounting surface 14 and support mounting surface 18 against relative movement. Engagement of proximal 44 and distal 42 connectors prevents accidental withdrawal of the web fastener 22.

Figure 9:
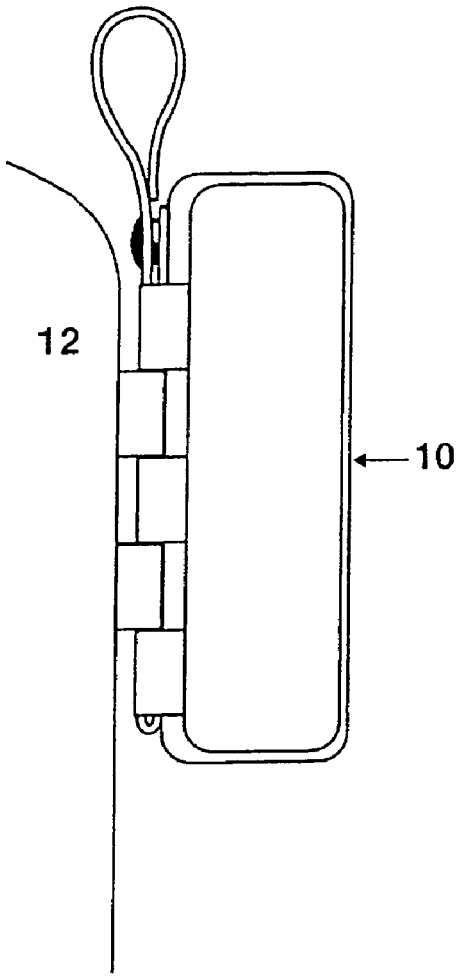
FIG. 9 shows a cross sectional view of a second embodiment.
Figure 10:
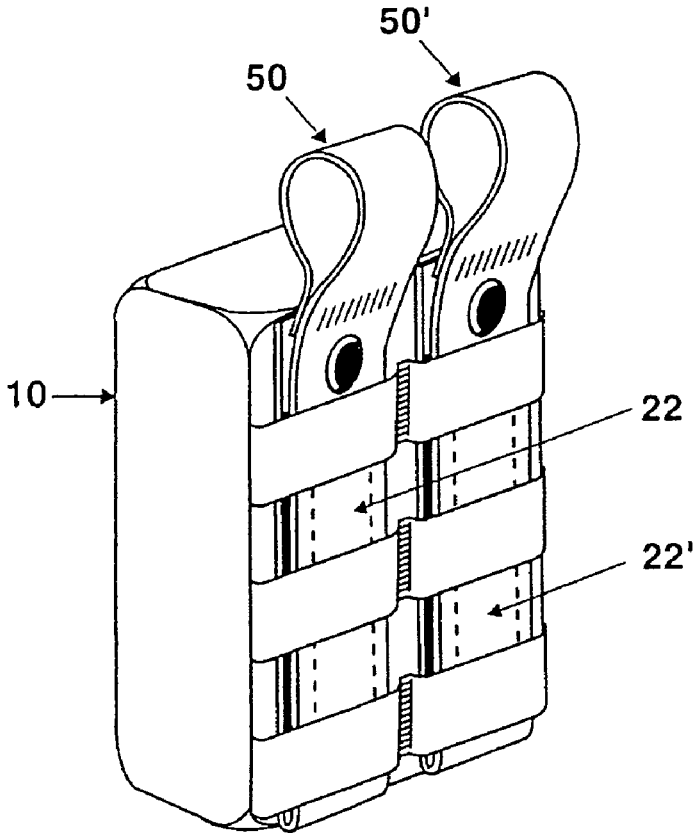
FIG. 10 shows a perspective view of the embodiment illustrated in FIG. 9.

In a second embodiment illustrated in FIGS. 9 and 10, web fastener 22 comprises a loop 50 formed by attachment of distal end 34 to article mounting surface 14. This facilitates the quick and easy withdrawal of the web fastener 22 from its interlocking position and the disengagement of article 10 from support 12 by a user who simply inserts a finger or suitable object into loop 50 and pulls with sufficient force to disengage the proximal 42 and distal 44 connectors and withdraw web fastener 22 from the juxtaposed webbing channels.

In a third embodiment the article 10 with its associated webbing is provided separately and for attachment to any suitably modified support.

In a fourth embodiment the fastening system is incorporated into a military kit.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. For instance, in the embodiment described and illustrated, the article 10 is a pocket but it will be understood that with adjustments that will be readily apparent to those skilled in the art, the system and method described herein may be applied to the attachment of all manner of articles including but not limited to pouches, covers, holsters, gun supports, pads, shields, panels, load carrying supports or other holders, and the like. Similarly, whilst in the illustrated embodiment the support envisaged is a belt, the same method and system may be applied to directly mount articles on all manner of clothing and other types of flexible and non-flexible support including but not limited to jackets, pants, boots, headgear, tents, tarpaulins, covers, screens, vests, harnesses, load bearing equipment and particularly individual load bearing equipment such as backpacks and carrying harnesses and the like. Although in the embodiment illustrated two support webbing strips and three article webbing strips are provided, this is not essential. At least one webbing strip must be provided on each of the article and the support. Additional webbing strips may be employed provided that resulting article webbing channels can be readily juxtaposed with corresponding support webbing channels. The nature and magnitude of any necessary adjustments will be readily apparent to, and readily achieved by, those skilled in the art.

The connecting elements employed in the embodiments illustrated are the parts of a snap fastener but a range of alternatives will be readily apparent to those skilled in the art including VELCRO™, various hook and eye arrangements, the use of multiple snap fasteners on one web fastener and any other releasable connector elements, likewise, alternate positionings for the connectors are possible and are envisaged. Unsuitable types of connector and unsuitable positions therefore, will be readily discerned and avoided by those skilled in the art.

Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. The term "flexible" is synonymous with "un-stiffened", the term "web fastener" includes a "webbing strip" adapted to serve that purpose. The term "similar" applied to any relative quantitative or qualitative representation indicates that this can vary without resulting in a change of the basic function to which it is related. The degree of variance permissible will depend on context and application but will be readily apparent to those skilled in the art in any given situation. Likewise the terms "substantially" and "generally" as used herein may be applied to modify any quantitative representation that can permissibly vary without resulting in a change in the basic function to which it is related. The word "juxtaposed" indicates that the elements referred to are positioned in such alignment to each other as is necessary to achieve the basic object for which such relative positioning is required as illustrated by the various embodiments presented herein.

All publications, including but not limited to patents and patent applications, cited in this specification are incorporated herein by reference as if each individual publication were specifically and individually indicated to be incorporated by reference herein and as though fully set forth herein. The subject matter claimed includes all embodiments and variations substantially as hereinbefore described and with reference to the examples and drawings.

The embodiments of the invention in which an exclusive right or privilege is claimed are defined as follows:

1. An article adapted to be mounted to a support comprising a support webbing channel, said article comprising:

(a) an article webbing strip attached to an article mounting surface on said article and defining an article webbing channel with said article mounting surface, said article mounting surface being matable with the support mounting surface to juxtapose said article webbing channel with the support webbing channel when said article is mounted to the support;

(b) a web fastener comprising:

(i) a fixed end attached to said article and a distal end not attached to said article, so that when said article is mounted to said support said web fastener extends from said fixed end through and between said juxtaposed said article webbing channel and said support webbing channel to a fold in said web fastener, said web fastener then returning back through the juxtaposed said article webbing channel and said support webbing channel to said distal end;

(ii) a flexible portion; and (iii) a stiffened portion that is more rigid than the flexible portion;

(iv) wherein after said article has been mounted on the support, said flexible portion of said web fastener extends between said fixed end of said web fastener and said fold and said stiffened portion of said web fastener extends between said fold and said distal end.

2. The article of claim 1 wherein said stiffened portion of web fastener is spaced apart from said fixed end by means of said flexible portion.

3. The article of claim 1 wherein, when said article is mounted to said support, both the flexible portion and the stiffened portion of the web fastener extend through and between said juxtaposed channels.

4. The article of claim 1 wherein, in a state of attachment between the article and the support, the stiffened portion of the web fastener has a length sufficient to extend completely along an entire depth of the support webbing channel and to extend completely along an entire depth of the article webbing channel.

5. The article of claim 1 wherein said stiffened portion is capable of bending during a dismounting of the article from the support.

6. The article of claim 1 wherein:

said stiffened portion of said web fastener and said flexible portion of said web fastener are each long enough to extend through and between the juxtaposed said support webbing channel and said article webbing channel after said article has been mounted to said support.

7. The article of claim 1 wherein in a position of engagement between the article and the support, the web fastener is folded back upon itself so that a two-layered extent of the web fastener extends through and between the juxtaposed said support webbing channel and said article webbing channel.

8. The article of claim 7 wherein said two-layered extent of the web fastener is comprised by said flexible portion and said stiffened portion.

9. The article of claim 7 wherein, in said position of engagement between the article and the support, a quick release of the article from the support can be performed by means of a pulling force being applied to said distal end of said web fastener along a length of said web fastener.

10. An article adapted to be mounted to a support comprising a support webbing channel, said article comprising:

(a) an article webbing strip attached to an article mounting surface on said article and defining an article webbing channel with said article mounting surface, said article mounting surface being matable with the support mounting surface to juxtapose said article webbing channel with the support webbing channel when said article is mounted to the support;

(b) a web fastener comprising:

(i) a fixed end attached to said article and a distal end not attached to said article, so that when said article is mounted to said support said web fastener extends from said fixed end through and between said juxtaposed said article webbing channel and said support webbing channel to a fold in said web fastener, said web fastener then returning back through the juxtaposed said article webbing channel and said support webbing channel to said distal end;

(ii) a flexible portion;

(iii) a stiffened portion that is more rigid than the flexible portion;

(iv) a distal connecting element borne by said distal end of said web fastener and a proximal connecting element borne by said proximal end of said web fastener, said distal connecting element being connectable to, and disengageable from, a proximal connecting element.

11. The article of claim 10 wherein said article further comprises:

(a) more than one said article webbing channel; or (b) more than one said web fastener; or (c) more than one said article webbing channel and more than one said web fastener.

12. The article of claim 10 wherein said support is an article of clothing and said article is a pocket, a holster, a gun support or a holder.

13. The article of claim 10 wherein said support is individual load bearing equipment and said article is a pocket, a holster, a gun support or a holder.

14. A fastening system for mounting an article to a support, the fastening system comprising:

(a) an article webbing strip attached to an article mounting surface on said article, defining an article webbing channel between said article webbing strip and said article mounting surface;

(b) a support webbing strip attached to a support mounting surface on said support, defining a support webbing channel between said support webbing strip and said support mounting surface, said support mounting surface being matable to said article mounting surface to juxtapose said support webbing channel and said article webbing channel when said article is mounted to said support; and (c) a web fastener comprising:

(i) a fixed end attached to said article and a distal end not attached to said article, whereby:

(A) during an engagement position between said article and said support said web fastener extends from said fixed end through the juxtaposed said article webbing channel and said support webbing channel to a fold in said web fastener, said web fastener then returning back through the juxtaposed said article webbing channel and said support webbing channel to said distal end;

(B) during a release of said article from said support, from said engagement position, a pulling of said distal end causes:

(1) said web fastener to roll back along itself to withdraw said web fastener from said juxtaposed said article webbing channel and said support webbing channel; and (2) said fold moves in a direction along said web fastener toward said fixed end and said web fastener continues to roll back along itself until said web fastener is withdrawn from said juxtaposed said article webbing channel and said support webbing channel;

(ii) a flexible portion extending lengthwise between said fixed end and said distal end; and (iii) a stiffened portion that is more rigid than said flexible portion and extending lengthwise successive with said flexible portion between said fixed end and said distal end.

15. A fastening system for mounting an article to a support, the fastening system comprising:

(a) an article webbing strip attached to an article mounting surface on said article, defining an article webbing channel between said article webbing strip and said article mounting surface;

(b) a support webbing strip attached to a support mounting surface on said support, defining a support webbing channel between said support webbing strip and said support mounting surface, said support mounting surface being matable to said article mounting surface to juxtapose said support webbing channel and said article webbing channel when said article is mounted to said support; and, (c) a web fastener comprising:

(i) a fixed end attached to said article and a distal end not attached to said article, so that when said article is mounted to said support said web fastener extends from said fixed end through the juxtaposed said article webbing channel and said support webbing channel to a fold in said web fastener, said web fastener then returning back through the juxtaposed said article webbing channel and said support webbing channel to said distal end;

(ii) a flexible portion; and (iii) a stiffened portion that is more rigid than said flexible portion;

(iv) wherein after said article has been mounted to said support, said flexible portion of said web fastener extends between said fixed end of said web fastener and said fold and said stiffened portion of said web fastener extends between said fold and said distal end.

16. A military kit comprising the fastening system of claim 15.

17. The fastening system of claim 15 wherein:

(a) said article comprises two said article webbing channels, said two said article webbing channels being generally mutually parallel;

(b) said support comprises two said support webbing channels, said two support webbing channels being generally mutually parallel; and (c) in a position of engagement between said article and said support, said stiffened portion of said web fastener is adapted to extend through and between ones of said two support webbing channels and ones of said two article webbing channels;

(d) in a position of engagement between said article and said support, said flexible portion of said web fastener is adapted to extend through said two support webbing channels and to extend through said two article webbing channels.

18. The fastening system of claim 15 wherein said stiffened portion of web fastener is spaced apart from said fixed end by means of said flexible portion.

19. The fastening system of claim 15 wherein, when said article is mounted to said support, both the flexible portion and the stiffened portion of the web fastener extend through and between said juxtaposed channels.

20. The fastening system of claim 15 wherein, in a state of attachment between the article and the support, the stiffened portion of the web fastener has a length sufficient to extend completely along an entire depth of the support webbing channel and to extend completely along an entire depth of the article webbing channel.

21. The fastening system of claim 15 wherein said stiffened portion is capable of bending during a dismounting of the article from the support.

22. The fastening system of claim 15 wherein:

(a) said article comprises a plurality of said article webbing strips;

(b) said support comprises a plurality of said support webbing strips;

(c) in a static position of engagement between the article and the support, the plurality of support webbing strips are interdigitated with the plurality of article webbing strips, thereby defining a plurality of interdigitated support and article webbing channels;

(d) said stiffened portion of said web fastener has a length sufficient to extend through said plurality of interdigitated support and article webbing channels in said static position of engagement between the article and the support.

23. The fastening system of claim 15 wherein in a position of engagement between the article and the support, the web fastener is folded back upon itself so that a two-layered extent of the web fastener extends through and between the juxtaposed said support webbing channel and said article webbing channel.

24. The fastening system of claim 23 wherein said two-layered extent of the web fastener is comprised by said flexible portion and said stiffened portion.

25. The fastening system of claim 23 wherein, in said position of engagement between the article and the support, a quick release of the article from the support can be performed by means of a pulling force being applied to said distal end of said web fastener along a length of said web fastener.

26. A fastening system for mounting an article to a support, the fastening system comprising:

(a) an article webbing strip attached to an article mounting surface on said article, defining an article webbing channel between said article webbing strip and said article mounting surface;

(b) a support webbing strip art ached to a support mounting surface on said support, defining a support webbing channel between said support webbing strip and said support mounting surface, said support mounting surface being matable to said article mounting surface to juxtapose said support webbing channel and said article webbing channel when said article is mounted to said support; and (c) a web fastener comprising:

(i) a fixed end attached to said article and a distal end not attached to said article, so that when said article is mounted to said support said web fastener extends from said fixed end through the juxtaposed said article webbing channel and said support webbing channel to a fold in said web fastener, said web fastener then returning back through the juxtaposed said article webbing channel and said support webbing channel to said distal end;

(ii) a flexible portion; and (iii) a stiffened portion that is more rigid than said flexible portion;

(iv) a distal connecting element borne by said distal end of said web fastener and a proximal connecting element borne by said proximal end of said web fastener, said distal connecting element being connectable to, and disengageable from, said proximal connecting element.

27. The fastening system of claim 26 wherein:

said stiffened portion of said web fastener and said flexible portion of said web fastener are each long enough to extend through and between the juxtaposed said support webbing channel and said article webbing channel after said article has been mounted to said support.

28. The fastening system of claim 26 wherein:

(a) said article comprises two said article webbing channels, said two said article webbing channels being generally mutually parallel;

(b) said support comprises two said support webbing channels, said two support webbing channels being generally mutually parallel; and (c) said stiffened portion of said web fastener is adapted to extend through and between ones of said support webbing channels and ones of said article webbing channels to thereby restrain relative movement of said article and said support.

29. The fastening system of claim 28 further comprising two said web fasteners.

30. The fastening system of claim 29 wherein said support is an article of clothing and said article is a pocket, a holster, a gun support or a holder.

31. The fastening system of claim 29 wherein said support is individual load bearing equipment and said article is a pocket, a holster, a gun support or a holder.

32. A method for connecting an article to a support by inserting a web fastener through and between juxtaposed webbing channels, said method comprising providing a fastening system comprising:

(a) an article webbing strip attached to an article mounting surface on said article, defining an article webbing channel between said article webbing strip and said article mounting surface;

(b) a support webbing strip attached to a support mounting surface on said support, defining a support webbing channel between said support webbing strip and said support mounting surface, said support mounting surface being matable to said article mounting surface to juxtapose said support webbing channel and said article webbing channel when said article is mounted to said support; and, (c) a web fastener comprising:

(i) a fixed end attached to said article and a distal end, so that said web fastener extends from said fixed end to said distal end in an orientation that permits said web fastener to pass through the juxtaposed said article webbing channel and said support webbing channel when said article is mounted to said support;

(ii) a flexible portion; and (iii) a stiffened portion that is more rigid than said flexible portion;

(iv) wherein after said article has been mounted on said support, said flexible portion of said web fastener extends between said fixed end of said web fastener and said fold and said stiffened portion of said web fastener extends between said fold and said distal end.

33. The method of claim 13 wherein said stiffened portion of web fastener is spaced apart from said fixed end by means of said flexible portion.

34. The method of claim 32 wherein, when said article is mounted to said support, both the flexible portion and the stiffened portion of the web fastener extend through and between said juxtaposed channels.

35. The method of claim 32 wherein, in a state of attachment between the article and the support, the stiffened portion of the web fastener has a length sufficient to extend completely along an entire depth of the support webbing channel and to extend completely along an entire depth of the article webbing channel.

36. The method of claim 32 wherein said stiffened portion is capable of bending during a dismounting of the article from the support.

37. The method of claim 32 wherein:

said stiffened portion of said web fastener and said flexible portion of said web fastener are each long enough to extend through and between the juxtaposed said support webbing channel and said article webbing channel after said article has been mounted to said support.

38. The method of claim 32 wherein in a position of engagement between the article and the support, the web fastener is folded back upon itself so that a two-layered extent of the web fastener extends through and between the juxtaposed said support webbing channel and said article webbing channel.

39. The method of claim 38 wherein said two-layered extent of the web fastener is comprised by said flexible portion and said stiffened portion.

40. The method of claim 38 wherein, in said position of engagement between the article and the support, a quick release of the article from the support comprises applying a pulling force to said distal end of said web fastener along a length of said web fastener.

41. A method for connecting an article to a support by inserting a web fastener through and between juxtaposed webbing channels, said method comprising providing a fastening system comprising:

(a) an article webbing strip attached to an article mounting surface on said article, defining an article webbing channel between said article webbing strip and said article mounting surface;

(b) a support webbing strip attached to a support mounting surface on said support, defining a support webbing channel between said support webbing strip and said support mounting surface, said support mounting surface being matable to said article mounting surface to juxtapose said support webbing channel and said article webbing channel when said article is mounted to said support; and (c) a web fastener comprising:

(i) a fixed end attached to said article and a distal end, so that said web fastener extends from said fixed end to said distal end in an orientation that permits said web fastener to pass through the juxtaposed said article webbing channel and said support webbing channel when said article is mounted to said support;

(ii) a flexible portion; and (iii) a stiffened portion that is more rigid than said flexible portion;

(iv) a distal connecting element borne by said distal end of said web fastener and a proximal connecting element borne by said proximal end of said web fastener, said distal connecting element being connectable to, and disengageable from, said proximal connecting element.

42. The method of claim 41 wherein:

(a) said article comprises two said article webbing strips;

(b) said support comprises two said support webbing strips; and (c) said stiffened portion length is suitable to extend through and between a plurality of interdigitating said support webbing channels and said article webbing channels.

43. The method of claim 41 further comprising providing two said web fasteners.

44. The method of claim 43 wherein said support is an article of clothing and said article is a pocket, a holster, a gun support or a holder.

45. The method of claim 43 wherein said support is individual load bearing equipment and said article is a pocket, a holster, a gun support or a holder.

46. A fastening system for mounting an article to a support, the fastening system comprising:

(a) two article webbing strips attached to an article mounting surface on said article, defining a plurality of article webbing channels between said article webbing strips and said article mounting surface;

(b) two support webbing strips attached to a support mounting surface on said support, defining a plurality of support webbing channels between said support webbing strips and said support mounting surface, said support mounting surface being matable to said article mounting surface to juxtapose ones of said support webbing channels and ones of said article webbing channels when said article is mounted to said support; and, (c) two web fasteners, each said web fastener comprising:

(i) a fixed end attached to said article and a distal end, so that when said article is mounted to said support said web fastener extends from said fixed end through a juxtaposed said article webbing channel and said support webbing channel to a fold in said web fastener, said web fastener then returning back through the juxtaposed said article webbing channel and said support webbing channel to said distal end;

(ii) a flexible portion; and (iii) a stiffened portion that is more rigid than said flexible portion;

(iv) a snap fastener, mating parts of said snap fastener being positioned to connect said distal end of said web fastener proximate to said fixed end.

47. The fastening system of claim 46 wherein said stiffened portion of each said web fastener is spaced apart from said fixed end by means of said flexible portion.

48. The fastening system of claim 46 wherein, when said article is mounted to said support, both the flexible portion and the stiffened portion of each said web fastener extend through and between said juxtaposed channels.

49. The fastening system of claim 46 wherein, in a state of attachment between the article and the support, the stiffened portion of each said web fastener has a length sufficient to extend completely along an entire depth of the support webbing channel and to extend completely along an entire depth of the article webbing channel.

50. The fastening system of claim 46 wherein said stiffened portion is capable of bending during a dismounting of the article from the support.

51. The fastening system of claim 46 wherein in a position of engagement between the article and the support, each of said web fasteners is folded back upon itself so that a two-layered extent of each of said web fasteners extends through and between the juxtaposed said support webbing channels and said article webbing channels.

52. The fastening system of claim 51 wherein said two-layered extent of each of the web fasteners is comprised by said flexible portion and said stiffened portion.

53. The fastening system of claim 51 wherein, in said position of engagement between the article and the support, a quick release of the article from the support can be performed by means of a pulling force being applied to said distal end of both of said web fasteners along respective lengths of said web fasteners.

54. An assembly of an article, support, and a fastening system for releasably fastening the article to the support, said assembly comprising:

(a) an article;

(b) a support;

(c) a fastening system for releasably fastening the article to the support, the fastening system comprising:

(i) a plurality of spaced-apart article webbing strips attached to an article mounting surface on said article, defining a plurality of article webbing channels between respective ones of said article webbing strips and said article mounting surface;

(ii) a plurality of spaced-apart support webbing strips attached to a support mounting surface on said support, defining a plurality of support webbing channels between respective ones of said support webbing strips and said support mounting surface;

(iii) in a position of engagement between said article and said support, said support webbing channels and said article webbing channels being interdigitated;

(iv) at least one web fastener comprising:

(A) a fixed end attached to said article and a distal end spaced from said fixed end;

(B) a flexible portion adjacent to said fixed end;

(C) a stiffened portion that is more rigid than said flexible portion;

(v) in said position of engagement between said article and said support:

(A) said web fastener extends from said fixed end and through said interdigitated support and article webbing channels, said web fastener is then folded back upon itself, thereby forming a bight, said web fastener extending from said bight through said interdigitated support and article webbing channels to said distal end;

(B) said flexible portion of said web fastener extends between said fixed end and said bight;

(C) said stiffened portion of said web fastener extends between said bight and said distal end.

55. The assembly of claim 54 wherein the fastening system is provided with a means for quickly releasing said article from said support, said means comprising a grippable structure formed by said distal end of said web fastener, whereby, a pulling force applied to said grippable structure in a direction away from said interdigitated support and article webbing channels causes said flexible portion of said web fastener to roll back along itself, while in the interdigitated support and article webbing channels, to withdraw said web fastener from said interdigitated support and article webbing channels, thereby releasing said article from said support.

* * * * *